United States Patent [19]

Petruzzella

[11] 4,106,935

[45] Aug. 15, 1978

[54] XEROGRAPHIC PLATE HAVING AN PHTHALOCYANINE PIGMENT INTERFACE BARRIER LAYER

[75] Inventor: Nicholas L. Petruzzella, Columbus, Ohio

[73] Assignee: Xerox Corporation, Stamford, Conn.

[21] Appl. No.: 571,137

[22] Filed: Apr. 24, 1975

Related U.S. Application Data

[63] Continuation of Ser. No. 67,297, Aug. 26, 1970, abandoned, which is a continuation of Ser. No. 578,502, Sep. 12, 1966, abandoned.

[51] Int. Cl.[2] ..... G03G 5/08; G03G 5/082

[52] U.S. Cl. ..... 96/1.5 R

[58] Field of Search ..... 96/1 R, 1.5

[56] References Cited

U.S. PATENT DOCUMENTS

| | | | |
|---|---|---|---|
| 2,886,434 | 5/1959 | Owens | 96/1.5 |
| 2,901,348 | 8/1959 | Dessaver et al. | 96/1.5 |
| 2,962,376 | 11/1960 | Schaffert | 96/1 |
| 2,999,750 | 9/1961 | Miller et al. | 96/1.8 |
| 3,243,293 | 3/1966 | Stockdale | 96/1.5 |
| 3,397,086 | 8/1968 | Bartfai | 96/1.5 |
| 3,573,906 | 4/1971 | Goffe | 96/1 R |
| 3,928,034 | 12/1975 | Regensburger | 96/1.5 |

*Primary Examiner*—Roland E. Martin, Jr.
*Assistant Examiner*—John L. Goodrow
*Attorney, Agent, or Firm*—J. J. Ralabate; J. P. O'Sullivan; G. D. Maccarone

[57] ABSTRACT

There is disclosed an electrophotographic imaging member comprising a conductive substrate having coated thereover an interfacial barrier layer comprising phthalocyanine in an electrically insulating binder resin which layer is overcoated with a photoconductive layer comprising selenium. The member has substantially panchromatic response. The interfacial barrier layer comprising phthalocyanine in a binder acts as a surprisingly effective barrier layer against the injection of electrons from metallic bases.

8 Claims, 1 Drawing Figure

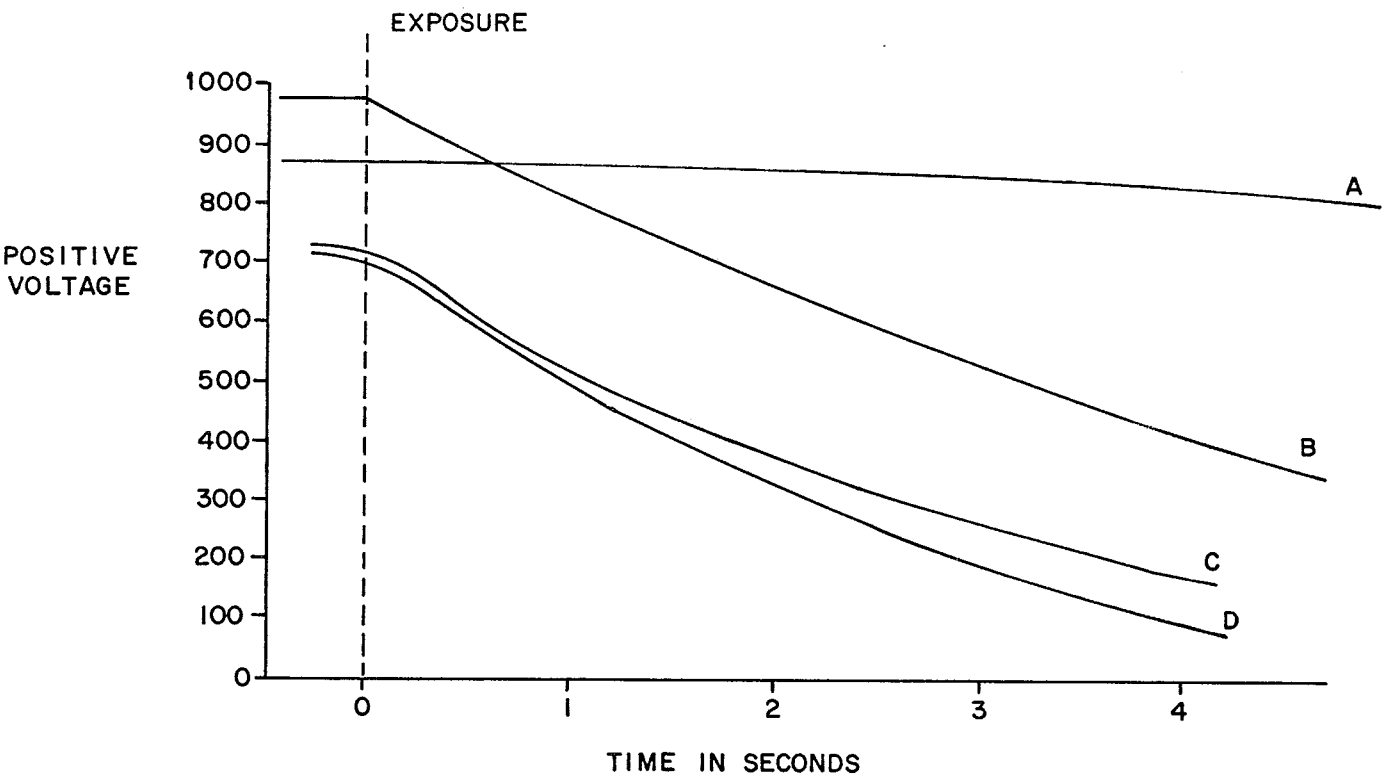
EXPOSURE
POSITIVE VOLTAGE
1000
900
800
700
600
500
400
300
200
100
0
A
B
C
D
0
1
2
3
4
TIME IN SECONDS

XEROGRAPHIC PLATE HAVING AN PHTHALOCYANINE PIGMENT INTERFACE BARRIER LAYER

This is a continuation, of application Ser. No. 67,297, filed Aug. 26, 1970, now abandoned, which is a continuation application of prior copending application, Ser. No. 578,502, filed Sept. 12, 1966, now abandoned.

This invention relates to photoconductive materials, and, more specifically, to photoconductive plates for use in xerography.

It is known that images may be formed and developed on the surface of certain photoconductive materials by electrostatic means. The basic electrophotographic process, as taught by Carlson in U.S. Pat. No. 2,297,691 involves uniformly charging a photoconductive insulating layer, then exposing the layer to a light- and shadow image which dissipates the charge on the portions of the layer which are exposed to light. The electrostatic latent image formed on the layer corresponds to the configuration of the light-and-shadow image. Alternatively, a latent electrostatic image may be formed on the plate by charging said plate in image configuration. In either case, the image may be rendered visible by depositing on the imaged layer a finely divided developing material comprising a colorant called a toner and a toner carrier. The powdered developing material will be attracted to those portions of the layer which retain a charge, thereby forming a powder image corresponding to the latent electrostatic image. This powder image may then be transferred to paper or other receiving surfaces. The paper then will bear the powder image which may subsequently be made permanent by heating or other suitable fixing means. The above general process is also disclosed in U.S. Pat. No. 2,357,809; 2,891,011 and 3,079,342.

That various photoconductive insulating materials may be used in making xerographic plates is known. Suitable photoconductive insulating materials such as anthracene, sulfur, selenium or mixtures thereof have been disclosed by Carlson in U.S. Pat. No. 2,297,691 and Bixby in U.S. Pat. No. 2,970,906. These materials generally have sensitivity in the blue or near ultra-violet range, and all but selenium have a further limitation of being only slightly light sensitive. Because of its greater sensitivity, selenium has been the most commercially accepted material for use in xerographic plates. Vitreous selenium, however, while desirable in many aspects, suffers from serious limitations in that its spectral response is largely limited to the ultra-violet, blue and green regions of the spectrum. This limited color response makes it especially difficult for copies of originals in red-on-black or blue-on-yellow or-orange to be copied with the selenium xerographic plates.

Where the selenium containing layer is supported by a conductive substrate, it has been found necessary to incorporate a barrier layer between the selenium containing layer and the conductive substrate. The requirements of this barrier layer are described in detail by Dessauer and Clark in U.S. Pat. No. 2,901,348. As pointed out in that patent, the barrier layer must be insulating in the dark to prevent the passage of electrons from the conductive substrate to the photoconductive layer and thereby prevents the loss of charge in such layer during the period between uniform charging of the plate and exposure to an image to be copied. On the other hand, where the barrier layer is a good insulator in the light, it may prevent complete discharge of exposed areas during imaging. This will tend to increase deposition of toner in background areas during development. Thus, the selection of barrier layer materials and thicknesses necessarily reflect a balance between high resistance in the non-light struck areas and low resistance in the light struck areas.

Xerographic plates using selenium containing photoconductive layers often suffer from problems due to poor adhesion between the photoconductive layer and the substrate. Differences in thermal expansion between the substrate and the photoconductive layer may cause cracking and peeling of the photoconductive layer from the substrate. The xerographic plate in a commercial machine is subjected to a substantial temperature difference between cool periods when out of use and unavoidable heating due to the close proximity of thermofusing means during the copying cycle. Problems of adhesion become much greater where the photoconductive layer is coated on a flexible belt substrate which is entrained around pulleys. Continuous flexing of the photoconductive layer often leads to cracks and separation from the substrate. Where a barrier layer is interposed, additional problems may result since the barrier layer must adhere well to the substrate and to the selenium containing overlayer under flexing stress. Selection of a barrier layer material which has good adhesion properties is limited by the requirements that the barrier layer be sufficiently insulating in the dark and not excessively insulating in the light struck areas.

It is, therefore, an object of this invention to provide xerographic plates which overcome the above-noted disadvantages.

Another object of this invention is to provide an electrophotographic plate having sensitivity to substantially the entire visible spectrum.

Another object of this invention is to provide a barrier layer for an electrophotographic plate which is highly insulating in the dark and less insulating when exposed to visible light.

Still another object of this invention is to provide a xerographic plate having improved adhesion between the photoconductive layer and the substrate.

Yet another object of this invention is to provide an improved xerographic imaging process.

The foregoing objects and others are accomplished in accordance with this invention, generally speaking, by providing a xerographic plate comprising a conductive substrate having coated thereover a layer comprising a phthalocyanine in an insulating resin binder which layer is overcoated with a layer containing selenium. This plate has substantially panchromatic spectral response since the selenium containing layer is primarily sensitive to light in the blue, green and ultra-violet regions while the phthalocyanine containing interlayer is primarily sensitive in the red and near infra-red region of the spectrum. The interlayer comprising phthalocyanine in a binder acts as a surprisingly effective barrier layer against the injection of electrons from metallic bases. In the dark, this interlayer in highly insulating preventing substantial dark decay and fatigue. However, during imaging, the light-struck areas of this interlayer become able to conduct charge from the metallic base into the selenium containing layer, and thus permit substantially complete, rapid discharge of the selenium containing layer in light-struck areas. Since no residual charge remains in light-struck areas, very little toner will be undesirably deposited in background areas thus producing a clean, high contrast image. This interlayer can be sufficiently thick to act as an efficient barrier layer during the period between electrostatic charging of the plate and the imaging step without undesirably blocking discharge during exposure. The binder resin for the phthalocyanine containing interlayer may be selected to provide optimum adhesion between the selenium containing layer and the substrate. While the binder must be substantially insulating, other characteristics and thicknesses may be selected so as to provide optimum adhesion rather than optimum barrier properties due to the presence of the phthalocyanine.

The conductive substrate may comprise any suitable material having the capability of acting as a ground plane for the xerographic plate. Typical conductive materials include metals such as aluminum, brass, stainless steel, copper, nickel, and zinc; conductively coated glass such as tin oxide, indium oxide or aluminum coated glass; similar coatings on plastic substrates; or paper rendered conductive by the inclusion of a suitable chemical therein or conditioning in a humid atmosphere to assure the presence therein of a sufficient water content to render the material conductive.

The selenium containing layer may comprise selenium or any suitable selenium alloy or mixture of other materials with selenium. Typical selenium alloys or selenium containing mixtures include cadmium selenide, cadmium sulfo-selenide, mixtures of sulfur and selenium such as are described by Carlson in U.S. Pat. No. 2,297,691; mixtures of arsenic and selenium such as are described by Mayer et al in U.S. Pat. No. 2,822,300; mixtures of selenium and tellurium as described by Paris in U.S. Pat. No. 2,803,541; arsenic selenide; tellurium selenide; and mixtures thereof. The selenium containing layer may include various sensitizing additives, such as the halogen dopants disclosed in copending application Ser. No. 516,529, filed Dec. 27, 1965 now U.S. Pat. No. 3,312,548. The selenium containing layer may have any suitable thickness. It is preferred that the selenium containing layer have a thickness of from about 5 to about 50 microns for optimum sensitivity, thermal and mechanical characteristics, and transmission in the red portion of the spectrum.

The interlayer may comprise any suitable phthalocyanine dispersed in an insulating binder resin. The alpha and "X" polymorphic crystalline forms of metal-free phthalocyanine have been found to give the highest photosensitivity together with the lowest dark discharge and are therefore the preferred phthalocyanines for use in the plate of this invention. The "X" polymorphic form of metal-free phthalocyanine is described in detail in copending application Ser. No. 505,723, filed Oct. 29, 1965 now U.S. Pat. No. 3,357,989. Any other form of phthalocyanine, metal-containing or metal-free, substituted or unsubstituted, monomeric or polymeric, may be used where suitable. Typical phthalocyanines include aluminum phthalocyanine, aluminum polychlorophthalocyanine, antimony phthalocyanine, barium phthalocyanine, beryllium phthalocyanine, cadmium hexadecachlorophthalocyanine, cadmium phthalocyanine, calcium phthalocyanine, cerium phthalocyanine, chromium phthalocyanine, cobalt phthalocyanine, cobalt chlorophthalocyanine, copper 4-aminophthalocyanine, copper bromochlorophthalocyanine, copper 4-chlorophthalocyanine, copper 4-nitrophthalocyanine, copper phthalocyanine, copper phthalocyanine, sulfonate, copper polychlorophthalocyanine, deuteriophthalocyanine, dysprosium phthalocyanine, erbium phthalocyanine, europium phthalocyanine, gadolinium phthalocyanine, gallium phthalocyanine, germanium phthalocyanine, hafnium phthalocyanine, halogen substituted phthalocyanine, holmium phthalocyanine, indium phthalocyanine, iron phthalocyanine, iron polyhalophthalocyanine, lanthanum phthalocyanine, lead phthalocyanine, lead polychlorophthalocyanine, cobalt hexaphenylphthalocyanine, copper pentaphenylphthalocyanine, lithium phthalocyanine, lutecium phthalocyanine, magnesium phthalocyanine, manganese phthalocyanine, mercury phthalocyanine, molybdenum phthalocyanine, naphthalocyanine, neodymium phthalocyanine, nickel phthalocyanine, nickel polyhalophthalocyanine, osmium phthalocyanine, palladium phthalocyanine, palladium chlorophthalocyanine, alkoxphthalocyanine, alkylaminophthalocyanine, alkylmercaptophthalocyanine, aralkylaminophthalocyanine, aryloxyphthalocyanine, arylmercaptophthalocyanine, copper phthalocyanine piperidine, cycloalkylaminophthalocyanine, dialkylaminophthalocyanine, diaralkylaminophthalocyanine, dicycloalkylaminophthalocyanine, hexadecahydrophthalocyanine, imidomethylphthalocyanine, 1,2 naphthalocyanine, 2,3 naphthalocyanine, octaaxaphthalocyanine, sulfur phthalocyanine, tetra-azaphthalocyanine, tetra-4-acetylaminophthalocyanine, tetra-4-aminobenzoylphthalocyanine, tetra-4-aminophthalocyanine, tetrachloromethylphthalocyanine, tetradiazophthalocyanine, tetra-4,4-dimethyloctaazaphthalocyanine, tetra-4,5-diphenylenedioxide phthalocyanine, tetra-4,5-diphenyloctaazaphthalocyanine, tetra-(6-methyl-benzothiazoyl) phthalocyanine, tetra-p-methylphenylaminophthalocyanine, tetramethylphthalocyanine, tetra-naphthotriazolylphthalocyanine, tetra-4-naphthylphthalocyanine, tetra-4-nitrophthalocyanine, tetra-perinaphthylene-4,5-octa-azaphthalocyanine, tetra-2,3-phenyleneoxide phthalocyanine, tetra-4-phenyloctaazaphthalocyanine, tetraphenylphthalocyanine, tetraphenylphthalocyanine tetracarboxylic acid, tetraphenylphthalocyanine tetrabarium carboxylate, tetraphenylphthalocyanine, tetra-calcium carboxylate, tetrapyridyphthalocyanine, tetra-4-trifluoromethylmercaptophthalocyanine, tetra-4-trifluoromethylphthalocyanine, 4,4-thionaphtheneoctaazaphthalocyanine, platinum phthalocyanine, potassium phthalocyanine, rhodium phthalocyanine, samarium phthalocyanine, silver phthalocyanine, silicone phthalocyanine, sodium phthalocyanine, sulfonated phthalocyanine, thorium phthalocyanine, thulium phthalocyanine, tin chlorophthalocyanine, tin phthalocyanine, titanium phthalocyanine, uranium phthalocyanine, vanadium phthalocyanine, ytterbium phthalocyanine, zinc chlorophthalocyanine, zinc phthalocyanine, and mixtures, dimers, trimers, oligomers, polymers, copolymers or mixtures thereof.

The phthalocyanine may be dispersed in finely powdered form in the binder material in any suitable proportion of photoconductor to binder. On a phthalocyanine pigment-dry binder weight basis, the useful range extends from about 2:1 to about 1:15. Optimum results are obtained when ratios from about 1:4 to about 1:10 are used, and, accordingly, this range is preferred. The phthalocyanine pigments may be incorporated in the dissolved or melted binder by any suitable means, such as strong shear agitation, preferably with simultaneous grinding. These methods include ball milling, roller milling, sand milling, ultrasonic agitation, high speed blending and any desirable combination of these methods. In addition to adding the phthalocyanine particles to the dissolved or melted binder material, they may also be added and blended into a dry or slurry form of the powdered binder material before it is heated or dissolved to make it film-forming.

The phthalocyanine containing layer may have any suitable thickness. Excellent results are obtained with thicknesses of up to about 5 microns. For optimum sensitivity of the overall photoconductive insulating layer and for most efficient operation as a barrier layer, it is preferred that the interlayer have a thickness of from about 0.5 to about 1 micron.

The binder material for the phthalocyanine pigment in the interlayer may comprise any suitable substantially insulating film-forming organic resin. It is preferred that the binder have good adhesion to selenium and mixtures containing selenium and to the selected conductive substrate material. As noted above, the resin may be selected primarily on the basis of its adhesion characteristics with respect to the chosen selenium containing layer and chosen substrate material without regard to insulating characteristics when exposed to light. Typical insulating film forming binders include urea-and melamine-aldehyde resins, polyimide resins, polycarbonate resins, silicone resins, epoxy and epoxy-phenolic resins, polyvinylcarbazole, and polyesters. Optimum adhesion both to substrates and to the overlying selenium containing layer as well as outstanding photosensitivity have been obtained with polycarbonate resins. Therefore, polycarbonates are preferred as the binder for the phthalocyanine in the interlayer.

The pigment-binder-solvent slurry (or the pigment-binder melt) may be applied to the substrate by any of the well-known painting or coating methods, including spraying, flow-coating, knife-coating, electrostatic coating, dip coating, reverse roll coating, etc. After the resin in the interface layer is cured, the selenium containing layer may be applied thereover by any suitable method. Coating by means of vacuum evaporation is preferred since it produces a smooth, uniform layer in the amorphous state.

The invention will be further understood upon reference to the drawing which shows curves demonstrating sensitivity of a plate of the present invention compared to prior art plates.

Referring now to the FIGURE, there is shown a set of photoconductive sensitivity curves for two plates. Potential on the plate at a given time is indicated along the vertical axis. Time, in seconds, after charging of the plate is indicated along the horizontal axis. Each plate is charged in the dark to a controlled initial potential. Then each plate is exposed to either red or white light which causes rapid charge decay in the photoconductive materials. Potential remaining on the plate in each case is continuously measured by means of a transparent-press vibrating-reed electrometer. Specific details of the preparation and testing of the plates are given in Example I below. Curve "A" represents a selenium plate with no interlayer, when exposed to red light. As can be seen, this plate has no red sensitivity. Curve "B" represents the exposure of a selenium plate with no interlayer to white light. This plate exhibits good photosensitivity, but shows some charge retention several seconds after exposure. Curves "C" and "D" represent a selenium plate having a phthalocyanine binder resin interface exposed to red and white light, respectively, This plate has high sensitivity in both red and white light. As can be seen from the curves, the phthalocyanine containing interlayer contributes both to higher sensitivity to red light and to lower residual potential on the plate after exposure. Of course, the resin present in interlayer improves adhesion of the selenium to the substrate as is further pointed out in the examples below. The interlayer comprising a phthalocyanine in a binder is superior to a binder-free layer of a phthalocyanine, since the binder greatly improves adhesion between the substrate and the selenium containing layer. Also, sensitivity is improved through the incorporation of an insulating binder, since the binder can support an electric field which promotes carrier injection into the selenium.

The following examples further define and describe the xerographic plate of the present invention. Parts and percentages are by weight unless otherwise indicated. The examples below should be considered to illustrate various preferred embodiments of the plate and process of the present invention.

EXAMPLE I

Two plates are prepared as follows:

(a) a five mil aluminum sheet is coated with a 50 micron layer of amorphous selenium by vacuum evaporation as described by Bixby in U.S. Pat. No. 2,970,906.

(b) a coating solution is prepared by dissolving about 2 parts of Lexan polycarbonate resin available from the General Electric Company in about 10 parts dioxane and about 10 parts dichloromethane. To this solution is added about 0.3 parts of the x-form of metal-free phthalocyanine. This solution is then flow-coated onto an aluminum substrate to a dry thickness of about 0.5 micron. The resin is partially cured at about 100° C. for about 5 hours. Over this interlayer is then applied a 50 micron layer of amorphous selenium by vacuum evaporation.

Each plate is then electrostatically charged to a positive potential by passing a corona discharge unit maintained at about 6,000 volts over the plates about 3 times as described by Carlson in U.S. Pat. No. 2,588,699. Each plate is then exposed to white light by means of a General Electric type T4Q/CL-200 tungsten quartz iodine lamp having a color temperature of about 2800° K. The photo-induced discharged characteristics of each of the plates is measured continuously using a Monroe transparent probe vibrating reed electrometer. The results are plotted in the figure. Curve B represents the sensitivity of the selenium plate without an interlayer while Curve D represents the sensitivity of the selenium plate having the interlayer. Each plate is then recharged to a positive potential and exposed to red light by means of a CS2-63 cut-off filter, available from Corning Glass, maintained between the light source and the plate. This filter transmits about 87 percent of the visible light at wavelengths greater than 630 millimicrons but less than one percent below 580 millimicrons. The sensitivity of each plate to the red light is measured and plotted in the figure. Curve A represents the selenium plate without the interlayer while Curve C represents the sensitivity of the selenium plate having the phthalocyanine-binder interlayer. As can be seen from the curves, the plates having the interlayer are generally more sensitive, especially to red light, and have lower residual charge remaining on the plate after exposure.

EXAMPLE II

Two plates are prepared as follows:

(a) A 30 micron layer of amorphous selenium is vacuum evaporated onto a 2 mil brass foil.

(b) A coating solution is prepared by dissolving about 4 parts Merlon, a polycarbonate resin available from the Mobay Chemical Company in about 20 parts toluene. To about 10 parts of this solution is added about 1 part of the alpha-form of metal-free phthalocyanine. A two mil brass foil is dip coated with this mixture to a dry thickness of about 0.6 micron. The resin is then partially cured by heating to about 100° C. for about 1 hour. A layer of amorphous selenium is then vacuum evaporated onto the resin surface to a thickness of about 30 microns.

Each foil is then flexed over a two inch radius. The foil having the selenium directly on the brass surface is observed to show cracks in the selenium and severe flaking. The foil having the phthalocyanine-binder resin interlayer is observed to have no cracks in the selenium layer, and its coating adheres firmly to the base.

EXAMPLE III

A coating solution is prepared by dissolving about 1 part SR-82, a silicone resin available from the General Electric Company in about 6 parts xylene. To this solution is added about 0.3 parts of the "X"-form of metal-free phthalocyanine. This solution is spray coated onto an aluminum substrate to a dry film thickness of about 0.8 micron. The plate is then heated to about 100° C. for about one hour. A 40 micron layer of amorphous selenium is then vacuum evaporated onto the resin surface. The plate is electrostatically charged by means of a corona discharge device operating at a negative potential of about 6,000 volts. The plate is exposed for about 10 seconds by projection using a black-and-white transparency in a Simmons-Omega D-3 Enlarger equipped with an f/4.5 lens and a tungsten light source operating about 2950° K. color temperature. The illumination level at the plate is about 4 footcandles. The resulting latent electrostatic image is developed by cascading electroscopic marking particles across the surface thereof as described by Walkup in U.S. Pat. No. 2,618,551. The resulting powder image is electrostatically transferred to a paper receiving sheet as described by Schaffert in U.S. Pat. No. 2,576,047. The image on the sheet is of good quality and corresponds to the projected image. The plate is then ready for reuse as by the above described process.

EXAMPLE IV

A coating solution is prepared by dissolving about 5 parts Pyre-ML-RK-692 (12 percent solids), an aromatic polyimide resin prepared by reacting pyromellitic dianhydride with a diamine, available from E. I. duPont de Nemours & Company in about 6 parts dimethyl formamide. To this solution is added about 0.1 parts of the "X"-form of metal-free phthalocyanine. This mixture is then coated onto an aluminum substrate to a dry thickness of about 0.7 micron. The resin is then cured to about 200° C. for about 1 hours. A 15 micron layer of amorphous selenium is then formed on the resin surface by vacuum evaporation. The plate is charged, exposed and developed as in Example III above. A good image corresponding to the original results.

EXAMPLE V

A coating solution is prepared by dissolving about 1 part Uformite MM-100, a melamine-formaldehyde resin available from the Rohm & Haas Company in about 10 parts butanol. To this solution is added about 0.4 part of the alpha-form of metal-free phthalocyanine. This mixture is coated onto an aluminum substrate to a dry film thickness of about 0.6 micron. The resin is cured by heating the plate to about 150° C. for about 2 hours. About a 30 micron layer of amorphous selenium is then vacuum evaporated onto the cured resin surface. The plate is then charged, exposed and developed as in Example III. An image of good quality results, corresponding to the original.

EXAMPLE VI

A coating solution is prepared by dissolving about 1 part Uformite F-240, a urea-formaldehyde resin, available from Rohm & Haas Company in a mixture of about 5 parts xylol and about 5 parts butanol. To this solution is added about 0.15 parts of the alpha-form of metal-free phthalocyanine. An aluminum substrate is coated with this mixture to a dry film thickness of about 1 micron. The plate is then heated to about 150° C. for about 1 hour to cure the resin. About a 40 micron layer of selenium is coated thereover. The plate is then charged, exposed and developed as in Example III above. A good quality image, corresponding to the original, results.

EXAMPLE VII

A coating solution is prepared by dissolving about 70 parts Epon 1007, an epoxy resin available from the Shell Chemical Company, in about 80 parts ethyl Cellosolve, an ethylene glycol monoethylether available from the Union Carbide Corporation. To this solution is added about 40 parts Methylon 75201, a phenol-formaldehyde resin available from the General Electric Company, and about 9 parts Uformite F-240, a ureaformaldehyde resin available from the Rohm & Haas Company. The mixture is stirred to insure complete solution. To this solution is added about 20 parts of the "X"-form of metal-free phthalocyanine. An aluminum substrate is coated with this mixture to a dry film thickness of about 0.7 micron. The plate is heated to about 180° C. for about 2 hours to cure the resins. A 50 micron layer of amorphous selenium is then vacuum evaporated onto the resin surface. The plate is then charged, exposed and developed as in Example III above. An image of good quality corresponding to the original is observed on the plate.

EXAMPLE VIII

A coating solution is prepared by dissolving about 2 parts Luvican X-170, a vinyl carbazole polymer available from Badische Anilin und Soda Fabrik A.G., in about 10 parts toluene. To this solution is added about 0.2 parts of the "X"-form of metal-free phthalocyanine. An aluminum substrate is coated with this solution to a dry film thickness of about 0.9 micron. The plate is heated to about 80° C. for about 1 hour to insure solvent removal. Over the resin surface is then coated by vacuum evaporation a 40 micron layer of amorphous selenium. The plate is then charged, exposed and developed as in Example III above. A good image, corresponding to the original is observed on the plate.

EXAMPLE IX

A coating solution is prepared by dissolving about 2 parts Staybelite Ester 10, a glycerol tri-ester of 50 percent hydrogenated weed resin, available from the Hercules Powder Company in about 10 parts toluene. To this solution is added about 0.25 parts finely divided Cyan Green 15-3100, a chlorinated copper phthalocyanine available from American Cyanamide. An aluminum substrate is flow coated with this mixture to a dry thickness of about 0.5 micron. About a 40 micron layer comprising about 50 percent selenium and 10 percent tellurium is then formed on the resin surface. This plate is then charged, exposed and developed as in Example III. An image of good quality corresponding to the original results.

EXAMPLE X

A coating solution is prepared by dissolving about 2 parts Lexan polycarbonate resin, available from the General Electric Company, in about 10 parts dioxane and about 10 parts dichloromethane. To this solution is added about 0.3 parts finely-divided alpha form metal-free phthalocyanine. An aluminum substrate is flow-coated with this mixture to a dry thickness of about 0.5 micron. About a 40 micron layer comprising about 90 percent selenium and about 10 percent tellurium is then formed on the resin surface as described by Mengali in U.S. Pat. No. 2,745,327. This plate is then charged, exposed and developed as in Example III. An image of excellent quality corresponding to the original results.

EXAMPLE XI

An epoxy phenolic coating solution is prepared as described in Example I(b). A 5 mil brass foil is coated with this solution to a dry thickness of about 0.5 micron. The plate is heated at about 40° C. for about 5 hours to partially cure the resin. About a 50 micron layer consisting of about 17 percent arsenic and about 83 percent selenium is then formed over the resin surface by the method described by Mayer et al in U.S. Pat. No. 2,822,300 the plate is then maintained at about 120° C. for about 40 hours to fully cure the resin. This plate is then charged, exposed and developed as in Example III. An image of good quality corresponding to the original results.

Although specific materials and conditions were set forth in the above Examples, those were merely illustrative of the present invention. Various other compositions, such as the typical materials listed above and various conditions, where suitable, may be substituted for those given in examples with similar results. The selenium containing layer and/or the phthalocyanine-binder resin layer may have other materials added thereto to enhance, sensitize, synergize or otherwise modify their properties. For example, either layer may have electrical or spectral sensitizers added thereto where desirable. The multi-layer plate of this invention has utility in other applications requiring photoreceptors with broad spectral response; e.g., vidicon systems.

Many other modifications and ramifications of the present invention will occur to those skilled in the art upon a reading of this disclosure. There are intended to be encompassed within the spirit of this invention.

What is claimed is:

1. In an electrophotographic imaging member consisting essentially of a conductive substrate, an interfacial barrier layer overlying said substrate and a photoconductive insulating layer comprising selenium overlying said barrier layer, said photoconductive insulating layer having a film thickness in the range of from about 5 to about 50 microns, the improvement comprising:

an interfacial barrier layer having a thickness from about 0.5 up to about 5 microns and containing phthalocyanine pigment dispersed in an insulating binder resin, the weight ratio of pigment to resin being in the range of from about 2:1 to about 1:15.

2. The imaging member of claim 1 wherein said conductive substrate is opaque.

3. The xerographic plate of claim 1 wherein said interfacial barrier layer comprises from about 4 to about 10 parts binder resin for each part phthalocyanine.

4. The xerographic plate of claim 1 wherein said interfacial barrier layer has a thickness of from about 0.5 to about 1 micron.

5. The xerographic plate of claim 1 wherein said phthalocyanine comprises the alpha-form of metal-free phthalocyanine.

6. The xerographic plate of claim 1 wherein said phthalocyanine comprises the "X"-form of metal-free phthalocyanine.

7. The xerographic plate of claim 1 wherein said insulating binder comprises a polycarbonate resin.

8. The xerographic plate of claim 1 wherein said photoconductive layer comprises a mixture of arsenic and selenium.

* * * * *